US006766789B2

(12) United States Patent
Yamakado et al.

(10) Patent No.: US 6,766,789 B2
(45) Date of Patent: Jul. 27, 2004

(54) INJECTOR DRIVING CONTROL APPARATUS

(75) Inventors: Makoto Yamakado, Tsuchiura (JP); Noriyuki Maekawa, Chiyoda (JP); Kiyotaka Ogura, Hitachinaka (JP); Kazutaka Hino, Hitachinaka (JP); Tohru Ishikawa, Kitaibaraki (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 10/173,413

(22) Filed: Jun. 18, 2002

(65) Prior Publication Data

US 2002/0189593 A1 Dec. 19, 2002

(30) Foreign Application Priority Data

Jun. 18, 2001 (JP) ..... 2001-182710

(51) Int. Cl.[7] ..... F02M 51/00

(52) U.S. Cl. ..... 123/490; 361/152; 123/387

(58) Field of Search ..... 123/490, 387, 123/457, 511; 361/152, 154, 155, 156, 160

(56) References Cited

U.S. PATENT DOCUMENTS 5,941,216 A * 8/1999 Arakawa ..... 123/490
6,407,593 B1 * 6/2002 Kawamoto et al. ..... 327/110
2002/0046729 A1 * 4/2002 Kyuuma et al. ..... 123/295

FOREIGN PATENT DOCUMENTS

JP 06-241137 8/1994

* cited by examiner

*Primary Examiner*—Willis R. Wolfe
*Assistant Examiner*—Johnny H. Hoang
(74) *Attorney, Agent, or Firm*—Antonelli, Terry, Stout & Kraus, LLP

(57) ABSTRACT

An injector driving control apparatus operates with minimum power consumption, while ensuring linearity (proportionality between the current supply duration and fuel injection volume of the injector) in a wide fuel pressure range. A coil current feedback circuit is provided for controlling the current feedback duration according to the fuel pressure after applying the current at a boost voltage. This enables optimal control of the injector, and, hence, an improvement in the fuel injection volume characteristics (linearity) and a reduction in the heat generated in the injector driving control circuits.

8 Claims, 8 Drawing Sheets

INJECTOR DRIVING CONTROL APPARATUS

BACKGROUND OF THE INVENTION

The present invention relates to an injector driving control apparatus for use in controlling a fuel injector for supplying fuel to an internal combustion engine; and, more particularly, the invention relates to a technique for achieving a wide dynamic fuel pressure range by controlling the fuel injection volume according to the waveform of the current being generated to drive the injector, instead of changing, in a wide range, the fuel pressure of the fuel supplied to the injector.

As set forth in Japanese Application Patent Laid-Open Publication No. Hei 06-241137, two target current levels for the initial phase of magnetic attractor, namely, a high current target value and a low current target value, are determined by excitation current control corresponding to changes in fuel supply pressure, and, thus, the durability and reliability, as well as the efficiency of operation of fuel injection solenoid valves are improved.

The injector controls the injection volume according to the time during which the current is to be supplied. In an operation that ensures linearity (proportionality between the current supply duration and the fuel injection volume of the injector) in a wide fuel pressure range, the following events occur.

The time from the start of supply of the current to the actual opening of the valve, that is, the delay in the opening timing of the valve, differs between a low fuel pressure state and a high fuel pressure state.

After valve opening, the time from the end of supply of the current to the actual closing of the valve has a relationship with the coil current value which exists during the end of supply of the current. In this regard, and as the coil current value at this time increases, the time to the actual closing of the valve (namely, the delay in the closing timing of the valve) becomes longer, with the result that the amount of fuel injected during this time increases.

These events, in turn, create the following problems.

If the current value is set for a low fuel pressure, increases in the fuel pressure will prevent the valve from opening, or, even if the valve opens, there will be a great delay in the opening of the valve. Therefore, with such a delay, since the application of a voltage higher than the battery voltage will have been completed by the time the valve opens, it will not be possible for the open status of the valve to be maintained. This problem relates to the duration of the current waveform.

Conversely, if the current value is set for a high fuel pressure, decreases in the fuel pressure will cause the valve to close too early. If the current supply duration is reduced in order to inject a smaller amount of fuel, the supply of current will be terminated when the current value is high, in spite of the fact that the application of a voltage higher than the battery voltage will not yet have been completed. In such a situation, compared with the situation in which the current supply duration increases and the supply of current is terminated with a low current value, the valve closing delay time increases, and this, in turn, increases the injection volume and deteriorates the linearity in a small injection volume region. This problem relates to the current value of the current waveform.

Also, the coil of the injector needs to have a low resistance and a low inductance to improve the valve opening/closing response of the injector.

Even if the application of the technique disclosed in conjunction with FIG. 4 of Japanese Application Patent Laid-Open Publication No. Hei 06-241137 is to be attempted for solving the above-described problems, since these techniques involve the use of a coil that is low in inductance, unless the high target current value is changed significantly, it will not be possible to avoid the above-described problem relating to the duration of the current waveform. Therefore, in view of the scale of the circuit elements and the heat produced therefrom, the application of the above-described technique is not realistic. Also, even if the application of the techniques disclosed in conjunction with FIG. 9 of Japanese Application Patent Laid-Open Publication No. Hei 06-241137 is to be attempted, such techniques cannot be adopted, since increases in the duration application of a voltage higher than the battery voltage will reduce the boost voltage and generate a great amount of heat.

SUMMARY OF THE INVENTION

To solve the problems described above, it is necessary to adjust either the current value of the coil, when a boost voltage is not applied thereto, or the duration of a large current value. More specifically, the coil current needs to be increased to a great enough value by applying a boost voltage to open the valve; and, immediately after the valve has opened, a closed circuit is formed by the coil of the injector and a current feedback diode (current free-wheel diode). After this, the magnetic energy stored within the coil is utilized to maintain the energized status of the valve without a voltage being applied, and this feedback duration of the current is adjusted according to the fuel pressure obtained.

For this reason, the injector driving control apparatus according to the present invention comprises an injector for supplying fuel to an internal combustion engine, a switching means for energizing the coil of the injector with current from a battery, a control circuit for controlling the switching means, a means for detecting the current flowing through the coil of the injector, a current feedback diode (current free-wheel diode) for feeding back the coil current of the injector, and a means for abruptly reducing the coil current of the injector. These elements are designed to operate so that a voltage is supplied to the coil of said injector from the start of energization to the attainment of a first target current value; then control is provided so as to stop the application of the voltage temporarily upon attainment of said first target current value and so as to supply the appropriate current by forming a closed circuit composed of the coil and said current feedback diode (current free-wheel diode); and, thereafter, the abrupt current reducing means is activated so as to ensure that the current value, when greater than a second current value that is smaller than said first current value, is reduced, and then that the appropriate voltage is applied to obtain said second current value.

The operation timing of the abrupt current reducing means is determined by performing a comparison between a coil current value that has been detected by said detection means and a value that has been set. The operation timing can also be changed according to a timing command signal sent from said control circuit.

In addition, there is provided a means for detecting the pressure of the fuel supplied to the injector; and, when the fuel pressure increases, the operation timing of the abrupt current reducing means will be changed for delayed operation.

Also, the coil current follow-up control section for obtaining each of said target current values is constructed so that the first stage of the control accomplishes energization by applying a boost voltage that is higher than the voltage of said battery, and so that the second stage of the control accomplishes energization by applying the battery voltage.

DESCRIPTION OF THE INVENTION

One embodiment of the injector driving control apparatus according to the present invention will be described in detail with reference to the drawings.

Figure 1:
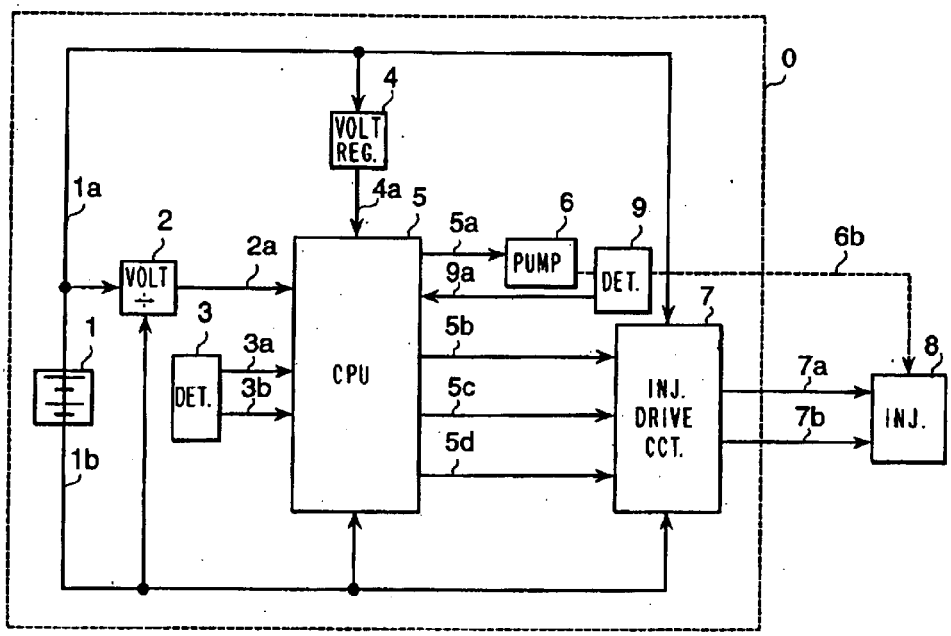
FIG. 1 is a block diagram showing the circuit composition of the injector driving control apparatus of the present invention.

FIG. 1 is a block diagram of an injector driving control apparatus for realizing the operation of the present invention.

In the injector driving control apparatus 0, a CPU 5 receives at least a reference position signal 3*a*, which indicates the piston position of an internal combustion engine, that is detected by an internal combustion engine rotation detector 3, and an angle signal 3*b*, which indicates the rotational speed of the internal combustion engine. A fuel pump 6 for supplying fuel to an injector 8 is controlled by a fuel pump control signal 5*a* received from CPU 5, and the pressure of the fuel supplied to injector 8 is detected by a fuel pressure sensor 9. The resulting fuel pressure is sent to CPU 5 as a fuel pressure signal 9*a*. Supply of power to elements of the injector driving control apparatus 0 is accomplished by supplying the voltage of a battery 1 as a battery power signal 1*a*; and, after converting this signal to an optimal voltage level by use of a regulated voltage circuit 4, the converted voltage is supplied to CPU 5 as a regulated voltage signal 4*a*. The voltage level of the battery 1 is converted to the optimal voltage level and input to the CPU 5 by a voltage dividing circuit 2, and the optimal voltage is supplied to CPU 5 as a battery voltage dividing signal 2*a*. After receiving this signal, the CPU 5 performs calculations to ensure optimal timing of fuel injection into the internal combustion engine, and sends the results to an injector driving circuit 7 via an injection pulse signal 5*b* and a valve opening pulse signal 5*c*. These signals are then used by the injector driving circuit 7 to control injector operation using an injector driving signal 7*a* and an injector driving GND signal 7*b*.

For simplicity of description, this embodiment assumes a single-cylinder internal combustion engine, and the processes leading up to the achievement of optimal fuel injection according to the operational status of this internal combustion engine by the injector 8 will be described hereinafter.

In order to inject the optimal amount of fuel from the injector, CPU 5 sends an injection fuel pressure signal, an injection pulse signal, and a valve opening pulse signal to fuel pump 6 and injector driving circuit 7 via signal lines 5*a*, 5*b*, and 5*c*, respectively. The injection pulse signal 5*b* is obtained by converting, into the valve opening duration of injector 8, the optimal volume of fuel injection that has been calculated from signals such as the reference position signal 3*a* and angle signal 3*b* (these are the output signals of internal combustion engine rotation detector 3), fuel pressure signal 9*a*, and battery voltage dividing signal 2*a*. The valve opening pulse signal 5*c* is obtained from CPU 5 after a sufficient time, from the start of valve opening of the injector 8, according to the particular level of the fuel pressure signal 9*a*, to the arrival of the valve at its opening position and the change to a valve-open hold status, has been calculated from signals, such as fuel pressure signal 9*a* and battery voltage dividing signal 2*a*, by the CPU.

Injector driving circuit 7 uses injection pulse signal 5*b* and valve opening pulse signal 5*c* to control the valve of the injector 8 via signal lines 7*a* and 7*b*.

Figure 2:
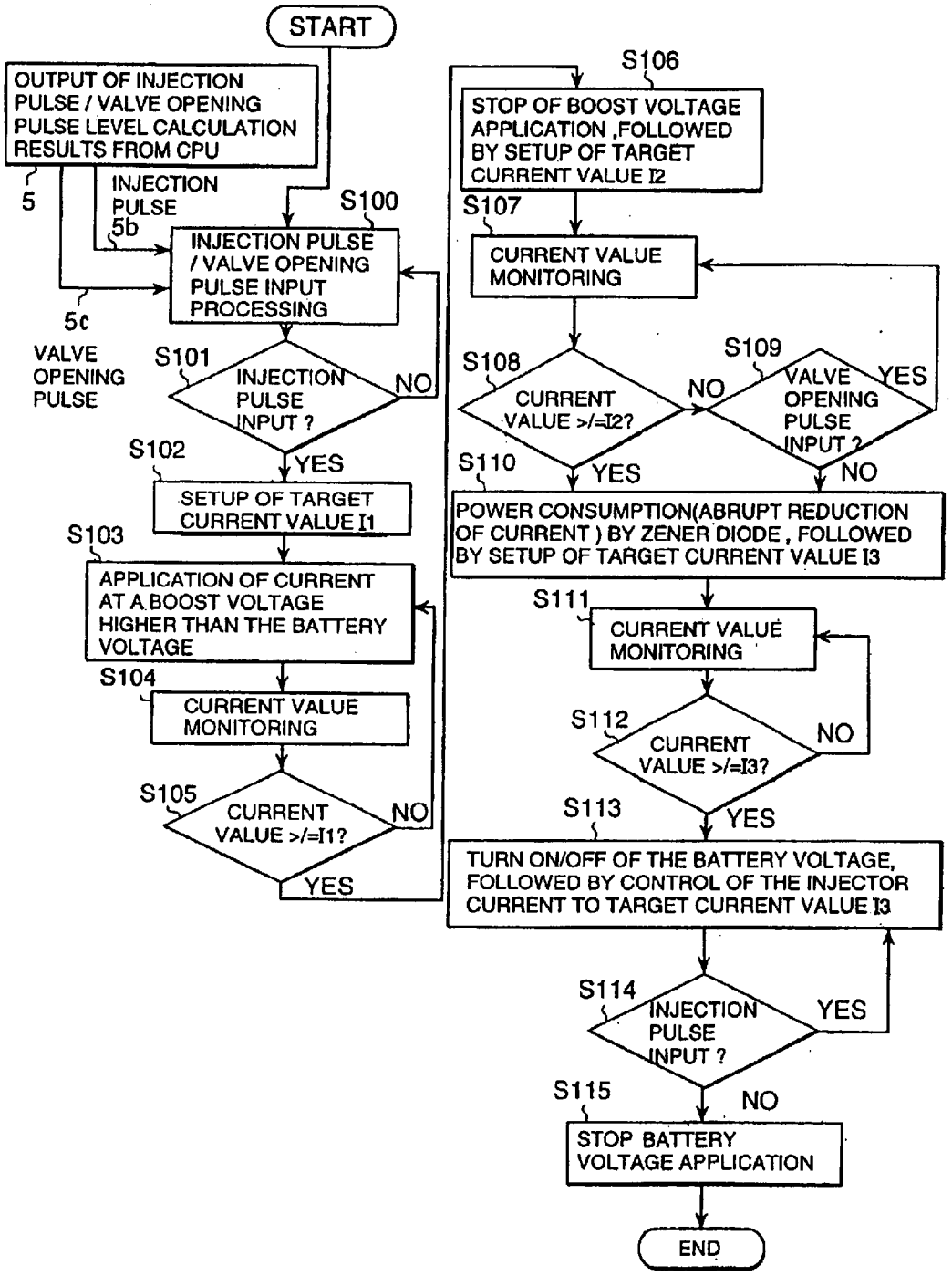
FIG. 2 is a flowchart showing the operation of the injector driving control apparatus of FIG. 1.

A flowchart illustrating the operation of the present invention is shown as FIG. 2.

In CPU 5, the optimal volume of fuel injection is calculated according to the particular operational status (rotational speed, load, etc.) of the internal combustion engine. Then, the results of this calculation are converted into a fuel pressure valve, an injection timing and an injection duration, and an injection pulse signal 5*b* is sent to injector driving circuit 7 (step S100 in the figure). At the same time, a sufficient time, from the start of valve opening of the injector, according to the detected fuel pressure, to the arrival of the valve at its opening position and the change to a valve-open hold status, is calculated by CPU 5, and the valve opening pulse signal 5*c* is sent to injector driving circuit 7 (S100). After it has been determined that the injector driving circuit 7 has received injection pulse signal 5*b* (S101), the first target current value I1 for activating the valve of the injector to start opening is set by injector driving circuit 7 (S102), and the injector is energized with a boost voltage greater than the battery voltage (S103). At this time, the magnitude of the current flowing through the injector is monitored (S104); and, when the valve of the injector starts opening and the current arrives at the first target current value I1 (S105), the injector will be de-energized (S106). At the same time, a clamping current value I2, smaller than the first target current value I1, is set (S106) to continue the opening motion of the valve until its open status has been maintained. This clamping current value becomes one of the two driving initiation conditions relating to the abrupt current reducing circuit composed of a Zener diode that is shown in the circuit composition of FIG. 3. The other condition is the turn-off timing of the valve opening pulse signal.

The value of the current flowing through the injector is monitored (S107); and, when the monitored current value decreases below I2 (S108), or when the valve opening pulse signal turns off (S109), the injector driving circuit 7 consumes the coil current by means of a Zener diode so as to abruptly reduce the current value. At the same time, a second target current value I3, smaller than the clamping current value I2, is set to hold the open status of the valve (S110). At this time, the value of the current flowing through the injector is monitored (S111); and, when the monitored current value decreases below I3 (S112), the injector current is controlled to the target current value I3 by means of the battery voltage (S113). After injection pulse signal 5*b* has been turned off (S114), energization with the battery voltage is stopped (S115), and the valve of the injector is moved back to the opening position of the valve (S115).

Figure 3:
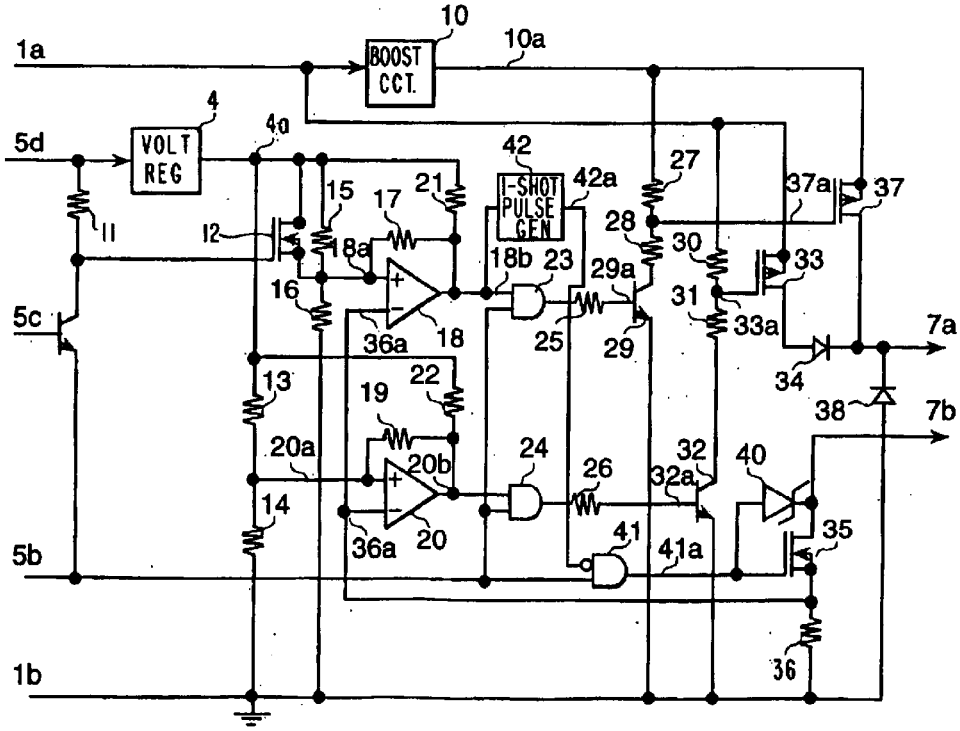
FIG. 3 is a schematic circuit diagram of the injector driving circuit shown in FIG. 1.

FIG. 3 is a schematic circuit diagram of the injector driving circuit 7 shown in FIG. 2.

Signal line 7*a*, one of the two driving signal lines for the injector 8, connects the drain of an FET 37, which is provided to apply a boost voltage signal 10*a* generated by a boosting circuit 10 (for example, a DC-DC converter), to the cathode of a diode 34. The anode of the diode 34 is connected to the drain of an FET 33 provided to apply a battery voltage 1*a* to injector 8. Diode 34 prevents the signal lines of the battery voltage 1*a* and boost voltage 10*a* from being short-circuited via the parasitic diode of the FET 33, when the FET 37 is on. Diode 38 holds the current of injector 8 in a free-wheel status when the boost voltage 10*a* is cut off by the FET 37.

Signal line 7*b*, the other driving signal line for injector 8, is connected to the drain of the FET 35 so as to establish the route for the flow of the current into injector 8 when the injection pulse signal 5*b* is turned on. The source of the FET 35 is connected to the GND signal line 1*b* of the above-mentioned battery 1 via a resistor 36 to detect the current flowing through injector 8. The current flowing through injector 8 is converted into a voltage value by the resistor 36, which voltage value is then sent to the minus terminals of comparators 18 and 20 via a signal line 36*a*.

When the flow of the current into FET 35 is cut off, the coil current is consumed by a Zener diode 40 and changed into thermal energy so as to generate heat. The generation of heat becomes significant if the flow of a particularly strong current into FET 35 is cut off.

Numeral 42 denotes a single-shot pulse generator, which is used to produce a pulse signal that determines the startup timing of the abrupt current reduction implemented by Zener diode 40.

Figure 4:
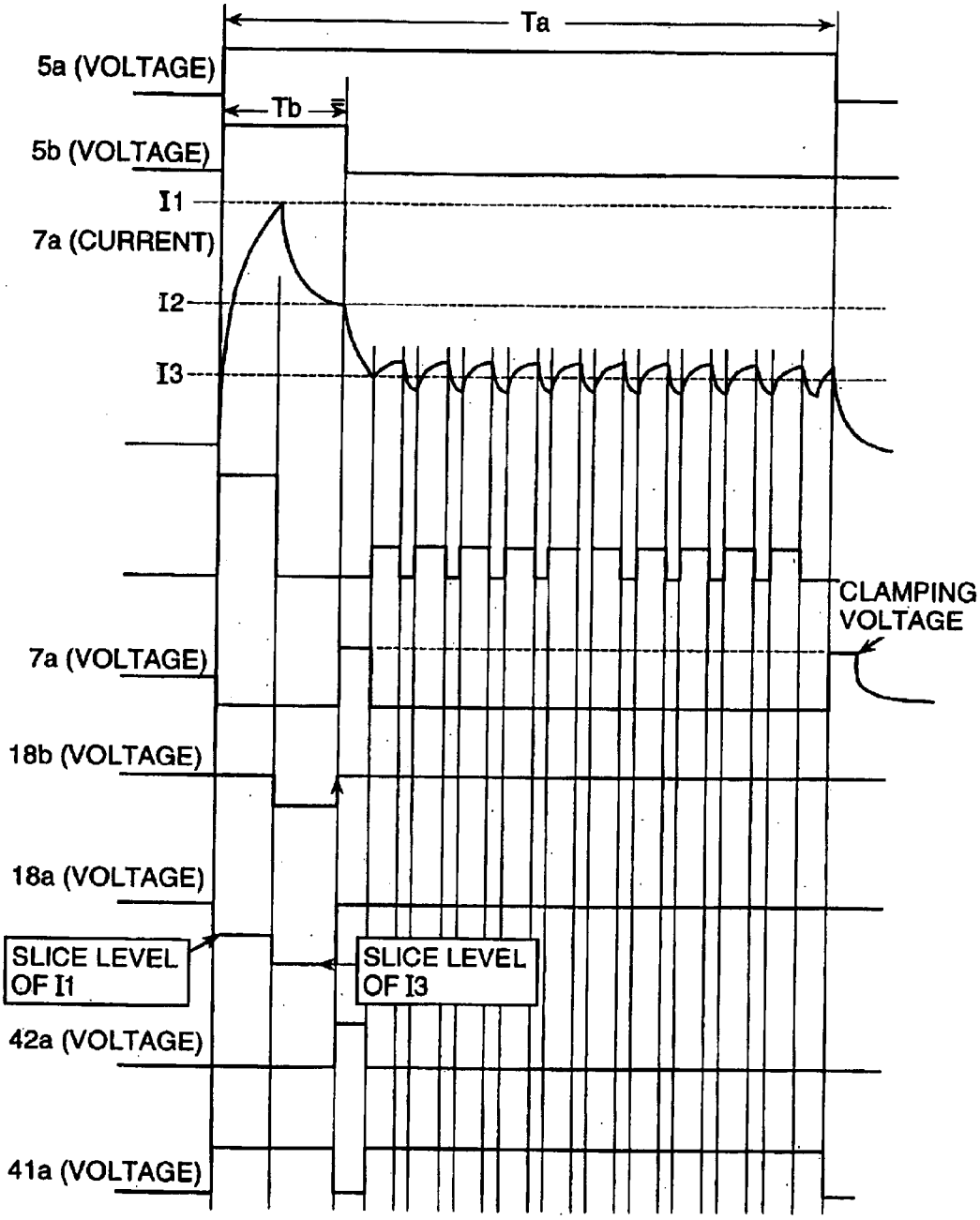
FIG. 4 is a timing chart showing the operation of the injector driving circuit of FIG. 3.

The operation of circuits will be described hereinafter with reference to FIGS. 3 and 4.

The application of boost voltage 10*a* to injector 8 will be described first. The plus terminal of the comparator 18 has a connected signal line 18*a*, which carries a signal that has been produced by dividing the output voltage 4*a* of a regulated voltage circuit 4 by resistors 15 and 16. The voltage level of the signal line 18*a* is provided with a hysteresis by means of a resistor 17. Signal line 18*a* sets the voltage level having a correlation with respect to the voltage value 36*a* obtained by converting the current value of injector 8. That is to say, a voltage level equivalent to the first target current value I1 is set for signal line 18*a*. Comparator 18 compares voltage level 36*a*, equivalent to the injector current value of the signal line connected to the minus terminal of the comparator, and the current value setting of the signal line connected to the plus terminal of the comparator, that is to say, a voltage level 18*a* equivalent to the first target current value I1. The current value obtained immediately after injection pulse signal 5*b* has been turned on is small since the current has just begun flowing into injector 8, and the voltage value 36*a* equivalent to this current value is also small. In other words, since the minus terminal of comparator 18 is smaller than its plus terminal, the output 18*b* of comparator 18 takes a high level. When the current value of injector 8 progressively increases, voltage value 36*a* equivalent to this current value also increases and thus the voltage level at the minus terminal of comparator 18 increases above the voltage level detected at its plus terminal. At this time, the output 18*b* of comparator 18 takes a low level.

When the output 18*b* of comparator 18 takes a high level, an AND gate 23 generates a high-level output signal, only while the output of injection pulse signal 5*b* is maintained. The high-level signal from the AND gate turns on a transistor 29 via a base resistor 25. When transistor 29 is on, the voltage 37*a* that is obtained by dividing boost voltage 10*a* by resistors 27 and 28 is applied to the gate of the FET 37, with the result that FET 37 is turned on, so as to apply the boost voltage 10*a* to the signal line 7*a* of injector 8. Similarly, when the output 18*b* of comparator 18 takes a low level, FET 37 is turned off so as to cut off the boost voltage 10*a* that has been applied to injector 8. In this way, the first target current value I1 to be applied to injector 8 is controlled.

Here, the values of resistors 15, 16 and 17 are set to the slice levels of I1 and I3.

Next, the operation of injector 8 in its current feedback mode will be described. When FET 37 is turned off and the application of the boost voltage is terminated, FET 35 is on, provided that the injection command signal is at a high level. At this time, the coil of injector 8 forms a closed circuit with terminal 7*b*, the detection resistor 36, FET 35, free-wheel diode (current feedback diode) 38, and a terminal 7*a*. Consequently, the coil current that has been enhanced by the boost voltage flows into the closed circuit mentioned above, and its energy is consumed by a coil resistor and the detection resistor 36. As described above, however, since the coil resistor is small-sized in order to satisfy response requirements, the attenuation of the current is sluggish. In this current feedback mode, therefore, it is possible to continue supplying a strong current to the coil without applying a voltage.

Next, the operation in the abrupt current feedback mode will be described. During input of the valve opening pulse signal 5*c*, voltage 18*b*, whose signal level was low under the cutoff status of the boost voltage when the value of the current being fed back became equal to 12, is active (see FIG. 4). Thereby, single-shot pulse generator 42 generates a short pulse signal. Thus, an AND operation is performed between this reversal signal and injection command pulse input 5*b*, resulting in the driving signal of FET 35 being obtained. When FET 35 is turned off, the current that has been flowing into FET 35 is consumed by Zener diode 40, with the result that the current is abruptly reduced.

Next, the application of battery voltage 1*a* to the injector 8 in order to make the current come up with the second target coil current value I3 is will be described.

When valve opening pulse signal 5*c* is on, FET 12 is on, and a voltage signal line 20*a*, carrying a signal obtained by dividing the output voltage 4*a* of regulated voltage circuit 4 by parallel resistors 11 and 13 and a resistor 14, is connected to the plus terminal of comparator 20. The voltage level of the signal line 20*a* is provided with a hysteresis by means of a resistor 19. Comparator 20 compares voltage level 36*a*, equivalent to the injector current value of the signal line connected to the minus terminal of the comparator, and the current value setting of the signal line connected to the plus terminal of the comparator, that is to say, a voltage level 20*a* equivalent to the second target current value I3. When the minus terminal is smaller than the plus terminal in terms of voltage, that is to say, when the current value of injector 8 is smaller than the second target current value I3, the output of comparator 20 takes a high level. Conversely, when the minus terminal is greater than the plus terminal in terms of voltage, that is to say, when the current value of injector 8 is greater than the second target current value I3, the output of comparator 20 takes a low level.

When the output 20*b* of comparator 20 takes a high level, an AND gate 24 generates a high-level output signal, only while output of injection pulse signal 5*b* is maintained. The high-level signal from the AND gate turns on a transistor 32 via a base resistor 26. When transistor 32 is on, the voltage 33*a* obtained by dividing battery voltage 1*a* by resistors 30 and 31 is applied to the gate of the FET 33, with the result that FET 33 is turned on so as to apply battery voltage 1*a* to the other signal line 7*a* of injector 8. Similarly, when the output 20*b* of comparator 20 takes a low level, FET 33 is turned off so as to cut off the battery voltage 1*a* that has been applied to injector 8. In this way, the second target current value I3 to be applied to injector 8 is controlled.

Figure 5:
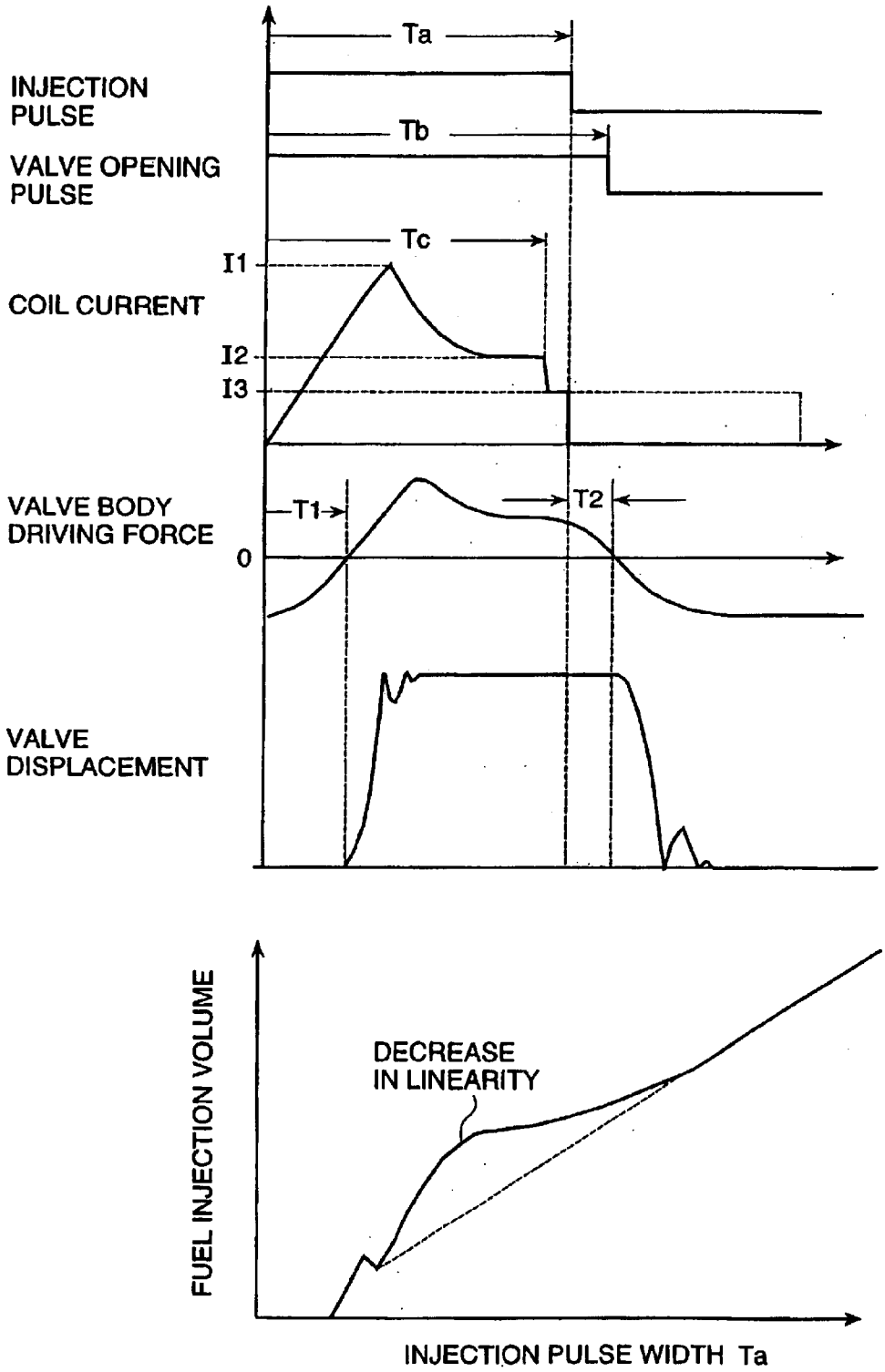
FIG. 5 is a waveform diagram showing the driving status existing at low fuel pressure and with a long current feedback duration.

The embodiment of the present invention using the control circuits of the above-described composition will be described in further detail hereinafter. FIG. 5 shows an injection pulse, a valve opening pulse, a coil current, valve body driving force, the valve displacement in injector 8, and the fuel injection volume relative to the injection pulse width.

The example shown in FIG. 5 applies to the case in which the abrupt current reduction circuit is activated with a large opening valve pulse width Tb by arrival of the current at previously set current value I2, not by the fall of the opening valve pulse. The example shown in this figure also assumes a relatively low fuel pressure.

When the valve body driving force exceeds zero (T1), valve displacement occurs and fuel injection is started. The valve body driving force is a resultant force consisting of physical factors, such as the magnetic attraction force produced by the excited coil, the spring force which tends to return the valve body in the closing direction of the valve, and the fuel pressure which tends to push the valve body in the closing direction of the valve. Increases in the fuel pressure, therefore, result in movement in a minus direction relative to the opening direction. Thus, when the fuel pressure increases, there will be a greater delay in the valve opening timing.

Next, when the injection pulse falls and the magnetic attraction force is attenuated by the termination of energization, the valve body driving force starts decreasing and the valve begins closing at the timing T2 so that the valve body driving force decreases below zero. If T2 is delayed, therefore, fuel injection will be continued even during that period.

In the example of FIG. 5, the attenuation of the coil current starts from around I2. When the injection pulse width Ta increases, however, although this is not shown in the figure, the attenuation of the coil current will start from I3. In this case, compared with T2 existing when the injection pulse interval is long, T2 at short injection pulse intervals will naturally increase the injection volume as well. As a result, as shown in FIG. 5, the linearity will decrease in a low injection volume region. This indicates that, since the current feedback duration (Tc) is too long for the assumed fuel pressure, the supply current value is too great.

Figure 6:
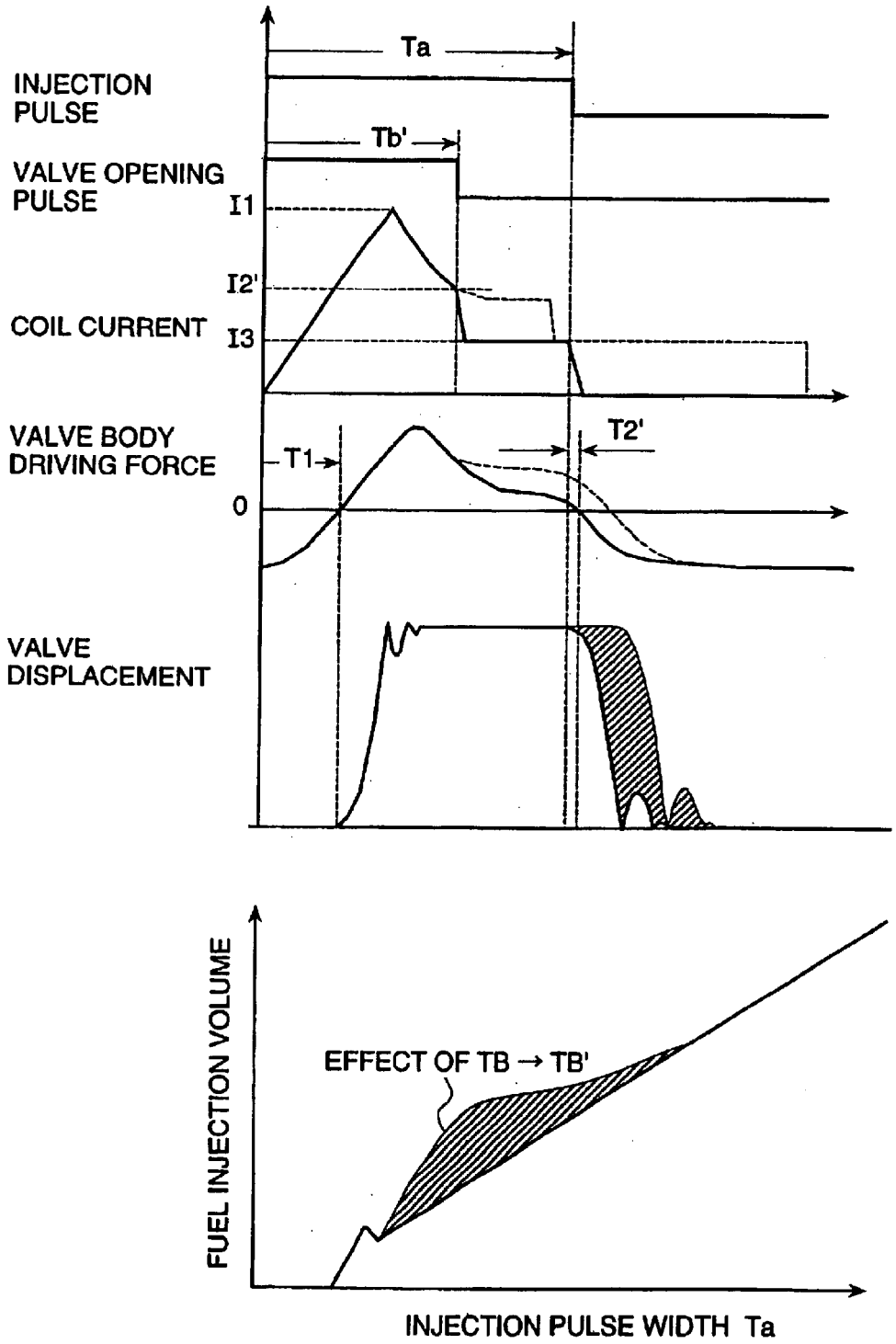
FIG. 6 is a waveform diagram showing the driving status existing at low fuel pressure and with a short current feedback duration.

FIG. 6 shows an example in which, by the application of the present invention, the valve opening pulse duration Tb is set to a shorter value Tb', whereby the current feedback duration is cut at the valve opening pulse Tb' and the mode is changed to abrupt current reduction. The coil current, after being abruptly reduced at Tb', is controlled to the second hold current level I3. In the end, when the injection pulse falls, the coil current is attenuated from I3. As shown by the solid line in FIG. 6, therefore, the valve body driving force significantly decreases at T2', the timing point at which the valve body driving force decreases below zero. Consequently, the valve also closes early and the injection volumes in the region shown by hatching in the figure are reduced.

Hereby, the linearity of the fuel injection volume with respect to the injection pulse width Ta is greatly improved.

Figure 7:
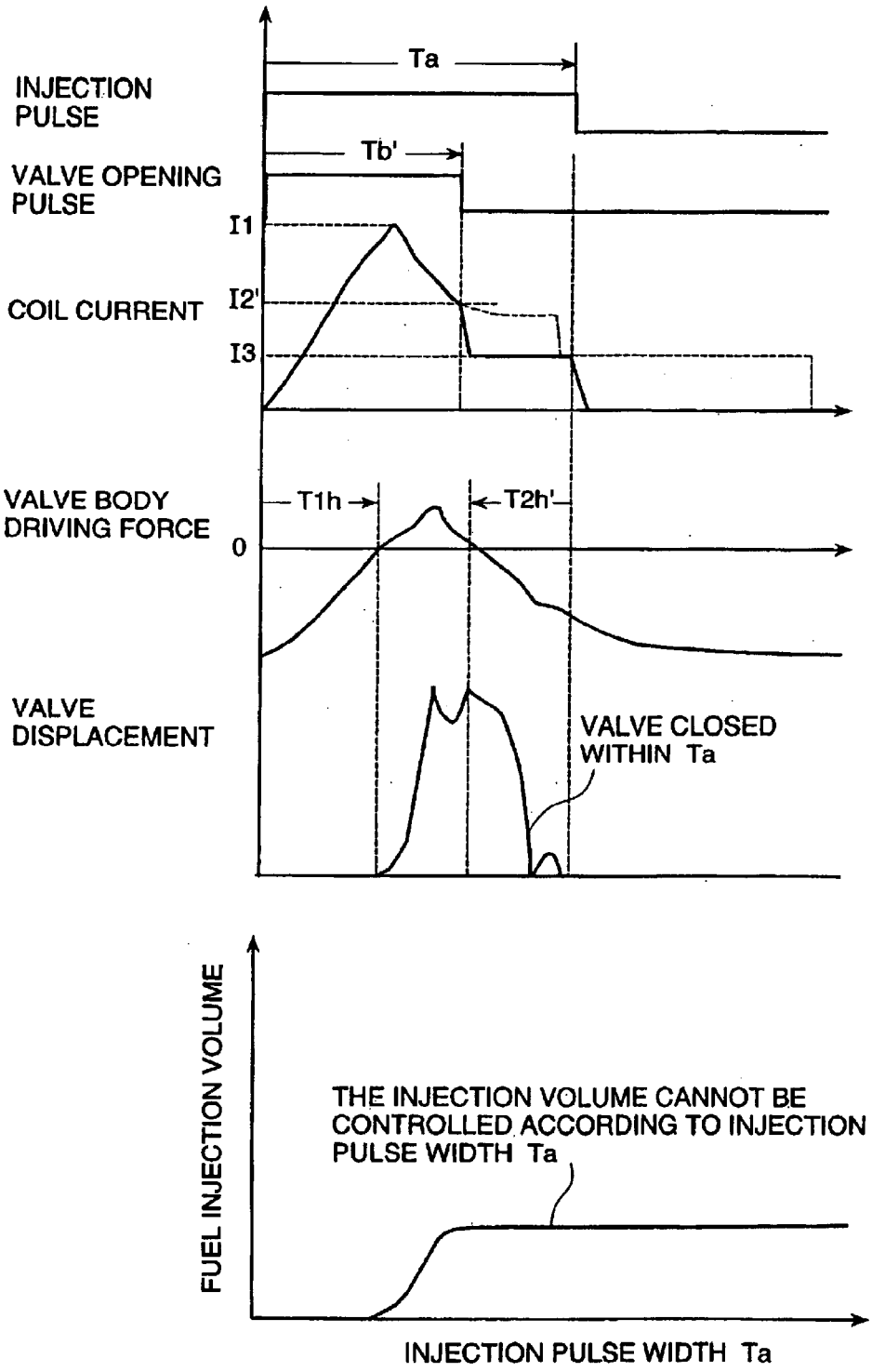
FIG. 7 is a waveform diagram showing the driving status existing at high fuel pressure and with a short current feedback duration.

FIG. 7 is a diagram showing an example in which a fuel pressure higher than that of FIG. 6 was supplied to injector 8, while employing the valve opening pulse width Tb' that yields the optimum linearity shown in FIG. 6, and the injector was driven. The high fuel pressure applies a large force in the closing direction of the valve body, reducing the driving force of the valve body significantly. For this reason, the valve-opening zero crossing point T1*h* is significantly delayed; and, in spite of continued injection pulse output, the valve-closing zero crossing point takes a shorter value (Ta−T2*h*'). This indicates that, even if the injection pulse width Ta is increased above Ta−T2*h*', the valve opening time will not increase, and, thus, the fuel injection volume will not increase either. In short, this shows that at a high fuel pressure, with the valve opening pulse width Tb' that was adopted in the example of FIG. 6, the injection volume cannot be controlled, because of the injection pulse width Ta, as shown in FIG. 7. Furthermore, the above-described example indicates that the current feedback duration is too short for the high fuel pressure assumed in FIG. 7.

Figure 8:
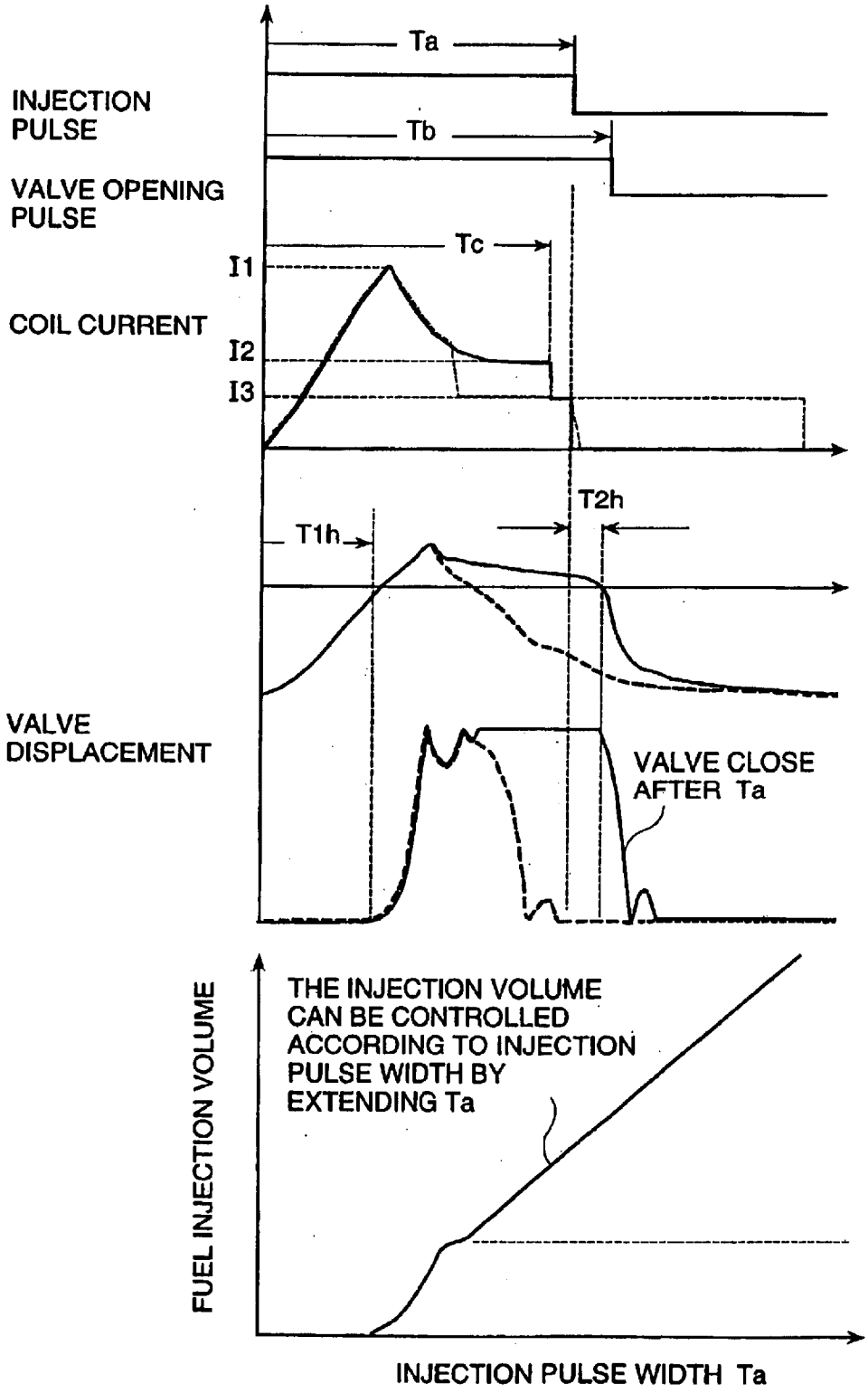
FIG. 8 is a waveform diagram showing the driving status existing at high fuel pressure and with a long current feedback duration.

As shown in FIG. 8, in the above-described situation, if the valve opening pulse width is returned to the Tb value assumed in the example of FIG. 5, the current feedback duration will be prolonged, and the valve body of injector 8 will close the valve after the injection pulse width Ta has been reached. Thus, injection control according to the particular injection pulse width will be possible, and the linearity will also improve.

In the end, the current feedback duration that was set in the example of FIG. 5 is too long for low fuel pressure, but moderate for high fuel pressure. Conversely, the current feedback duration that was set in the example of FIG. 6 is moderate for low fuel pressure, but too short for high fuel pressure.

The present invention provides a function that improves the linearity of the injection volume by adjusting the valve opening pulse width Tb according to the particular fuel pressure. More specifically, during fuel pressure detection, when the fuel pressure increases, the current feedback duration will be prolonged by increasing the valve opening pulse width Tb and, when the fuel pressure decreases, the current feedback duration will be prolonged by reducing Tb.

Figure 9:
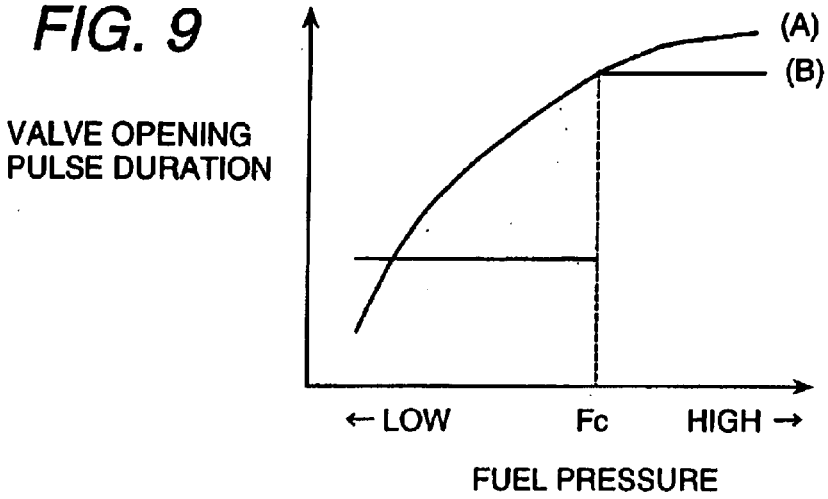
FIG. 9 is a graph showing the relationship between fuel pressure and the setting of a current feedback duration.

FIG. 9 is a graph representing the relationship between the supply fuel pressure to the injector, and the valve opening pulse duration. Data is set in CPU 5 so that, as shown in example (A), the valve opening pulse duration is reduced at low fuel pressure and increased at high fuel pressure.

Also, in example (B), unlike example (A) in which stepless control of the valve opening pulse duration is employed, independent suitable valve opening pulse duration values are set for high fuel pressure and low fuel pressure. Thus, the storage capacity required and the composition of the logic circuit can be minimized. Although two stages are employed in this example, more than two stages can also be provided, and the number of selectable stages can be determined in a practical range.

Figure 10:
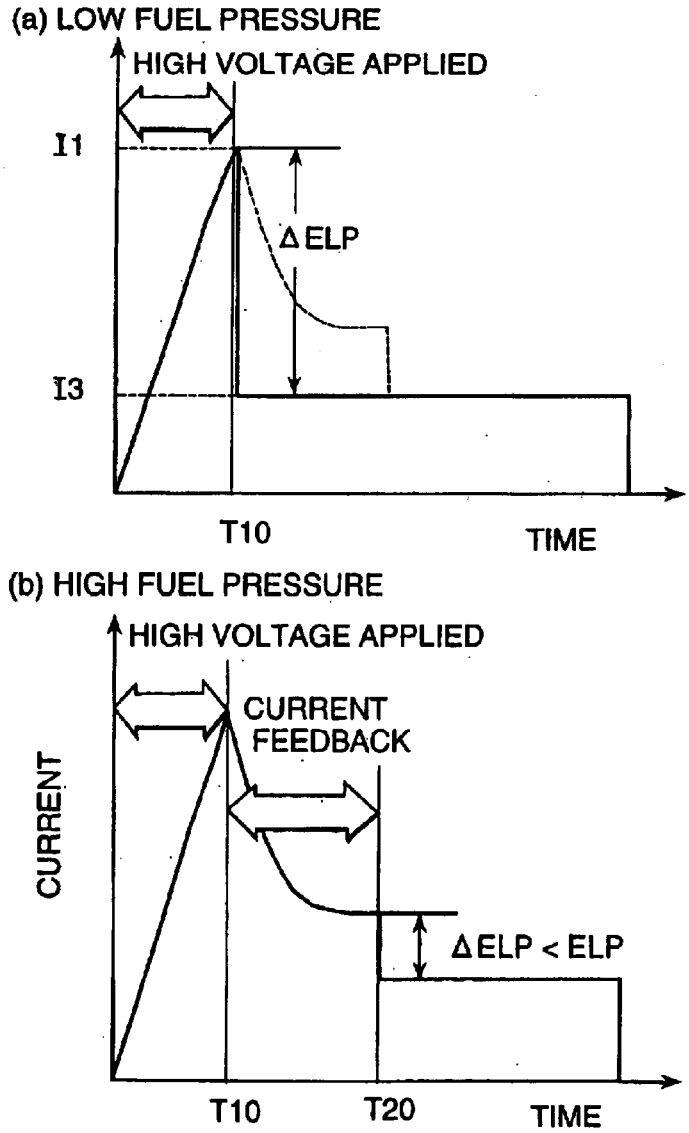
FIGS. 10(*a*) and 10(*b*) are graphs showing current-based comparisons between low fuel pressure and high fuel pressure, respectively.

FIGS. 10(*a*) and 10(*b*) provide graphs indicating that the injector driving control apparatus according to the present invention is valid for heat reduction. FIG. 10(*a*) shows the situation under which, at low fuel pressure, the injector is driven under the condition of a short current feedback duration (zero). High voltage is applied up to time T10, and the current is attenuated to I3 to maintain a large current value around I1. At this time, since the energy ΔELP, that is consumed by Zener diode 40 to abruptly reduce the current, is large, the amount of heat generated per driving cycle increases. However, since fuel injection at low fuel pressure occurs almost under low-speed driving conditions, the driving frequency of the injector is low and, the possibility of problems arising from the generation of heat is reduced.

At a high fuel pressure, on the other hand, as seen in FIG. 10(*b*), the current feedback duration is prolonged, and the energy ΔEHP, that is consumed by Zener diode 40 to abruptly reduce the current becomes much smaller than ELP, and the amount of heat generated per driving cycle decreases. At a high rotational speed, although fuel injection usually uses a high fuel pressure, since the amount of heat generated, per driving cycle is small, the possibility of problems arising from the generation of heat is reduced.

Irrespective of whether the fuel pressure is high or low, the boost high-voltage application duration is constant at T10, and this makes it unnecessary to add the time during which the boost voltage and the battery voltage are to be applied to the coil, which is very advantageous for heat reduction.

In this embodiment, although a particular circuit composition is disclosed by way of example with reference to FIG. 3, the composition of the present invention is not confined to what is disclosed and illustrated herein, and the invention is applicable to circuits provided with functions similar to those of the circuits described and shown in the drawings.

According to the present invention, it is possible to achieve linearity in the flow characteristics of an injector that is used at variable fuel pressures and, at the same time, to significantly reduce the amount of heat being generated.

What is claimed is:

1. An injector driving control apparatus comprising:

an injector having a coil for supplying fuel to an internal combustion engine;

switching means for energizing the coil of said injector from a battery;

a control circuit for controlling said switching means;

means for detecting a current flowing through the coil of the injector;

a current free-wheel diode for feeding back the coil current of the injector; and means for abruptly reducing the coil current of the injector;

wherein said injector driving control apparatus supplies a voltage to the coil of said injector from the start of energization to the attainment of a first target current value, then provides control so as to stop the application of the voltage temporarily on the attainment of said first target current value and so as to supply the appropriate current by forming a closed circuit composed of said coil and said current free-wheel diode, and thereafter activates the abrupt current reducing means so that the current value, when greater than a second current value smaller than said first current value, is reduced and then the appropriate voltage is applied to obtain said second current value;

wherein during coil current follow-up control for obtaining each of said target current values, a first stage of control accomplishes energization by applying a boost voltage higher than the voltage of said battery and second stage of control accomplishes energization by applying the battery voltage;

and said injector driving control apparatus is further characterized in that the operation timing of the abrupt current reducing means is determined by comparison between the coil current value that has been detected by said detection means and a current value that has been set, and in that said operation timing can also be changed according to a timing command signal sent from said control circuit.

2. An injector driving control apparatus as set forth in claim 1, further comprising means for detecting the pressure of the fuel supplied to said injector, and wherein, when the fuel pressure increases, the operation timing of said abrupt current reducing means is changed to effect delayed operation.

3. An injector driving control apparatus comprising:

an injector having a coil for supplying fuel to an internal combustion engine;

switching means for energizing the coil of said injector from a battery;

a control circuit for controlling said switching means;

means for detecting a current flowing through the coil of the injector;

a current free-wheel diode for feeding back the coil current of the injector; and means for abruptly reducing the coil current of the injector;

wherein said injector driving control apparatus supplies a voltage to the coil of said injector from the start of energization to the attainment of a first target current value, then provides control so as to stop the application of the voltage temporarily on the attainment of said first target current value and so as to supply the appropriate current by forming a closed circuit composed of said coil and said current free-wheel diode, and thereafter activates the abrupt current reducing means so that the current value, when greater than a second current value smaller than said first current value, is reduced and then the appropriate voltage is applied to obtain said second current value, and wherein the operation timing of the abrupt current reducing means is determined by comparison between the coil current value that has been detected by said detection means and a current value that has been set, and in that said operation timing can also be changed according to a timing command signal sent from said control circuit; and further comprising means for detecting the pressure of the fuel supplied to said injector, and wherein, when the fuel pressure increases, the operation timing of said abrupt current reducing means is changed to effect delayed operation, and wherein a plurality of operation timing values, commensurate with a plurality of fuel pressure ranges, intended for said abrupt current reducing means, are stored within the control circuit for said switching means.

4. An injector driving control apparatus as set forth in claim 3, wherein during coil current follow-up control for obtaining each of said target current values, a first stage of control accomplishes energization by applying a boost voltage higher than the voltage of said battery and second stage of control accomplishes energization by applying the battery voltage.

5. An injector driving control apparatus for use with an injector having a coil, comprising:

means for applying a voltage to the coil of the injector until a first target current value has been obtained and for providing control so that, once said first target current value has been reached, a closed circuit composed of said coil and a current free-wheel diode is formed through which an appropriate current is supplied;

means for reducing abruptly the value of said current when it is greater than a second current value that is smaller than said first current value;

first operation timing determination means for determining the operation timing of the abrupt current reducing means; and second operation timing determination means for determining the operation timing of said abrupt current reducing means preferentially over said first operation timing determination means, wherein said apparatus is characterized in that the operation timing of said abrupt current reducing means can be changed by use of said second operation timing determination means.

6. An injector driving control apparatus as set forth in claim 5, wherein said first operation timing determination means determines the operation timing of said abrupt current reducing means by comparing the coil current value and a value thereof, and wherein the operation timing of said abrupt current reducing means can also be changed by use of a timing command current signal received from a control circuit.

7. An injector driving control apparatus comprising:

an injector having a coil for supplying fuel to an internal combustion engine;

switching means for energizing the coil of said injector from a battery;

a control circuit for controlling said switching means;

means for detecting a current flowing through the coil of the injector;

a current free-wheel diode for feeding back the coil current of the injector; and means for abruptly reducing the coil current of the injector;

wherein said injector driving control apparatus supplies a voltage to the coil of said injector from the start of energization to the attainment of a first target current value, then provides control so as to stop the application of the voltage temporarily on the attainment of said first target current value and so as to supply the appropriate current by forming a closed circuit composed of said coil and said current free-wheel diode, and thereafter activates the abrupt current reducing means so that the current value, when greater than a second current value smaller than said first current value, is reduced and then the appropriate voltage is applied to obtain said second current value;

and said injector driving control apparatus is further characterized in that the operation timing of the abrupt current reducing means is determined by comparison between the coil current value that has been detected by said detection means and a current value that has been set, and in that said operation timing can also be changed according to a timing command signal sent from said control circuit.

8. An injector driving control apparatus as set forth in claim 7, further comprising means for detecting the pressure of the fuel supplied to said injector, and wherein, when the fuel pressure increases, the operation timing of said abrupt current reducing means is changed to effect delayed operation.

* * * * *